US009022525B2

(12) United States Patent
Hsueh et al.

(10) Patent No.: US 9,022,525 B2
(45) Date of Patent: May 5, 2015

(54) PAGE-WIDTH ARRAY PRINTING DEVICE

(71) Applicants: Ta-Wei Hsueh, Hsinchu (TW); Ying-Lun Chang, Hsinchu (TW); Hsien-Chung Tai, Hsinchu (TW); Yung-Lung Han, Hsinchu (TW); Chi-Feng Huang, Hsinchu (TW)

(72) Inventors: Ta-Wei Hsueh, Hsinchu (TW); Ying-Lun Chang, Hsinchu (TW); Hsien-Chung Tai, Hsinchu (TW); Yung-Lung Han, Hsinchu (TW); Chi-Feng Huang, Hsinchu (TW)

(73) Assignee: Microjet Technology Co., Ltd., Hsinchu (TW)

( * ) Notice: Subject to any disclaimer, the term of this patent is extended or adjusted under 35 U.S.C. 154(b) by 0 days.

(21) Appl. No.: 13/957,501

(22) Filed: Aug. 2, 2013

(65) Prior Publication Data

US 2014/0055526 A1 Feb. 27, 2014

(30) Foreign Application Priority Data

Aug. 27, 2012 (TW) ..... 101131041 A

(51) Int. Cl.
*B41J 2/155* (2006.01)
*B41J 2/14* (2006.01)

(52) U.S. Cl.
CPC ..... *B41J 2/155* (2013.01); *B41J 2/14145* (2013.01); *B41J 2002/14459* (2013.01); *B41J 2202/20* (2013.01)

(58) Field of Classification Search
CPC ..... B41J 2/155; B41J 2/175; B41J 2/17503; B41J 2/17509
USPC ..... 347/42
See application file for complete search history.

(56) References Cited

U.S. PATENT DOCUMENTS

| | | | | |
|---|---|---|---|---|
| 5,796,416 | A * | 8/1998 | Silverbrook | 347/47 |
| 5,914,737 | A * | 6/1999 | Silverbrook | 347/48 |
| 6,193,357 | B1 * | 2/2001 | Medin | 347/33 |
| 6,789,876 | B2 * | 9/2004 | Barclay et al. | 347/37 |
| 8,033,624 | B2 * | 10/2011 | Silva et al. | 347/4 |

* cited by examiner

*Primary Examiner* — Alessandro Amari
*Assistant Examiner* — Michael Konczal
(74) *Attorney, Agent, or Firm* — Kirton McConkie; Evan R. Witt

(57) ABSTRACT

A page-width array printing device includes a page-width array printing mechanism including at least one page-width array printing module. The page-width array printing module includes a printing platform, a first page-width array printing unit and a second page-width array printing unit. The first page-width array printing unit includes a plurality of first inkjet cartridges. The second page-width array printing unit includes a plurality of second inkjet cartridges. The first page-width array printing unit and the second page-width array printing unit are in parallel with each other. The first inkjet cartridges and the second inkjet cartridges are staggered and independently and detachably disposed on the printing platform. Each of the first inkjet cartridges and the second inkjet cartridges includes an inkjet chip. The inkjet chip includes four ink supply channels and a plurality of nozzles so as to perform a monochromatic or polychromatic page-width array printing operation.

8 Claims, 5 Drawing Sheets

PAGE-WIDTH ARRAY PRINTING DEVICE

FIELD OF THE INVENTION

The present invention relates to a printing device, and more particularly to a page-width array printing device.

BACKGROUND OF THE INVENTION

In a conventional inkjet printing device, an ink cartridge disposed on a supporting mechanism is moved back and forth along a horizontal direction by a moving mechanism. The ready-to-print paper is driven by a paper transfer mechanism to be transferred along a path under the ink cartridge along a vertical direction. After the ink within the ink cartridge is ejected onto a surface of the paper through an inkjet head, a print job is implemented. For printing out a required graphic/text manuscript, the inkjet head has to be moved back and forth and the paper has to be moved. Due to the limitations of the moving time and the accelerating/decelerating time, the printing speed of the conventional inkjet head is usually in the range between 30-35 PPM (pages per minute). In addition, it is difficult to increase the printing speed.

Since the conventional printing mechanism uses a simple supporting mechanism to fix the whole ink cartridge, move the ink cartridge and communicate with the inkjet printing device, the printing time and the print medium are restricted. For complying with diverse size of the print media and increasing the convenience and efficiency of the printing process, a page-width printing platform has been disclosed.

The conventional page-width printing platform has a fixed supporting platform. Moreover, the printing platform has a nozzle array with a width larger than or equal to that of the ready-to-print paper. The paper transferred through the path under the nozzle array is directly printed by the nozzle array. Under this circumstance, the printing platform is operated in a page-width array mode. In the page-width array mode, a plurality of inkjet chips are arranged at the bottom of the supporting mechanism of the printing platform, and thus the convenience and efficiency of the printing process will be enhanced. However, the printing platform in a page-width array mode still has the following drawbacks.

Firstly, since the inkjet chips are arranged at the bottom of the supporting mechanism of the printing platform, if one of the inkjet chips has a breakdown, the overall printing performance is deteriorated. Since the inkjet chip fails to be individually replaced with a new one, the whole printing platform should be replaced.

Secondly, for transferring the ink to the ink reservoirs which are in fluid communication with various inkjet chips, the page-width array printing platform should have complicated ink supply channels. Under this circumstance, the designing cost and the fabricating cost are both increased.

Thirdly, for fabricating the page-width array printing platform, it is necessary to successively install inkjet chips on the bottom of the supporting mechanism. Under this circumstance, the process of installing the controlling contacts becomes complicated, and thus the fabricating time and the fabricating cost are both increased.

Therefore, there is a need of providing an improved page-width array printing device in order to eliminate the above drawbacks.

SUMMARY OF THE INVENTION

The present invention provides a page-width array printing device. The page-width array printing device includes a plurality of inkjet cartridges and a printing platform. Since each of the inkjet cartridges is modularized and detachably connected to the printing platform, the problem of replacing the whole printing platform with a new one when one of the inkjet chips has a breakdown encountered in the prior arts are overcome and the processes of assembling the printing platform, replenishing the ink or replacing the inkjet cartridges are more convenient and cost-effective.

The present invention also provides a page-width array printing device for performing a monochromatic or polychromatic printing operation at a high printing speed by using a plurality of page-width array printing modules, each of which comprises a plurality of inkjet cartridges independently and detachably connected to the printing platform.

In accordance with an aspect of the present invention, there is provided a page-width array printing device. The page-width array printing device includes a page-width array printing mechanism including at least one page-width array printing module. The page-width array printing module includes a printing platform, a first page-width array printing unit and a second page-width array printing unit. The first page-width array printing unit includes a plurality of first inkjet cartridges. The second page-width array printing unit includes a plurality of second inkjet cartridges. The first page-width array printing unit and the second page-width array printing unit are in parallel with each other. The plural first inkjet cartridges and the plural second inkjet cartridges are staggered, and each of the plural first inkjet cartridges and the plural second inkjet cartridges is independently and detachably disposed on the printing platform. Each of the plural first inkjet cartridges and the plural second inkjet cartridges includes an inkjet chip, an ink reservoir and a flexible board controlling contact. Each inkjet chip includes four ink supply channels and a plurality of nozzles so as to perform a monochromatic or polychromatic page-width array printing operation.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

The present invention provides a page-width array printing device. The page-width array printing device comprises a page-width array printing mechanism 1 (see FIG. 3). The page-width array printing mechanism 1 is installed on a main body (not shown) for printing a print medium on the main body in a page-width array mode.

Figure 1:
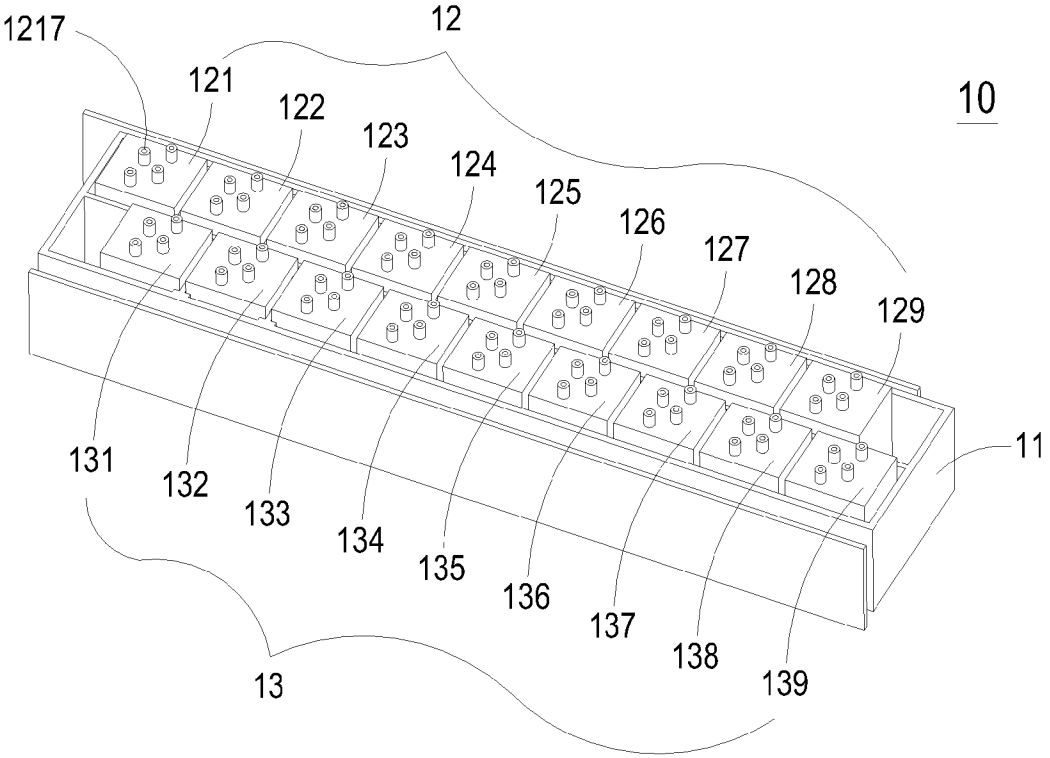
FIG. 1 is a schematic top view illustrating a page-width array printing module of a page-width array printing device according to an embodiment of the present invention.

The page-width array printing mechanism 1 comprises a first page-width array printing module 10. FIG. 1 is a schematic top view illustrating a page-width array printing module of a page-width array printing device according to an embodiment of the present invention. As shown in FIG. 1, the first page-width array printing module 10 comprises a printing platform 11, a first page-width array printing unit 12, and a second page-width array printing unit 13. The first page-width array printing unit 12 comprises a plurality of first inkjet cartridges 121~429, which are discretely arranged at an equal distance. Preferably, the first page-width array printing unit 12 comprises nine first inkjet cartridges 121~429, but it is not limited thereto. The second page-width array printing unit 13 comprises a plurality of second inkjet cartridges 131~439, which are discretely arranged at an equal distance. The first page-width array printing unit 12 and the second page-width array printing unit 13 are in parallel with each other. The number of the second inkjet cartridges is identical to the number of the first inkjet cartridges. Preferably, the second page-width array printing unit 13 comprises nine first inkjet cartridges 131~439, but it is not limited thereto. Moreover, the first inkjet cartridges 121~429 and the second inkjet cartridges 131~439 are staggered. Namely, the first inkjet cartridges 121~429 and the second inkjet cartridges 131~139 are misaligned with each other.

Figure 2:
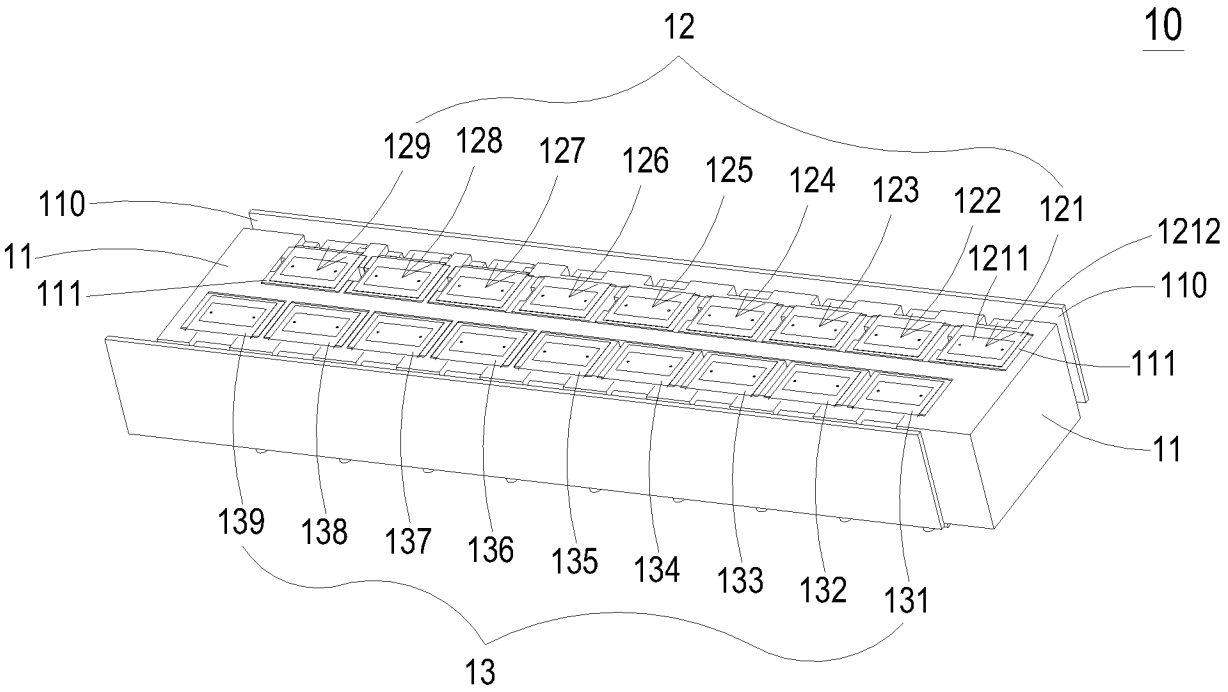
FIG. 2 is a schematic bottom view illustrating the page-width array printing module of the page-width array printing device of FIG. 1.

FIG. 2 is a schematic bottom view illustrating the page-width array printing module of the page-width array printing device of FIG. 1. Please refer to FIGS. 1 and 2. The first inkjet cartridges 121~129 of the first page-width array printing unit 12 and the second inkjet cartridges 131~139 of the second page-width array printing unit 13 are all disposed on the printing platform 11. More especially, the first inkjet cartridges 121~129 and the second inkjet cartridges 131~139 are independently and detachably disposed on the printing platform 11. For example, the first inkjet cartridge 121 comprises an individual inkjet chip 1211, an individual ink reservoir 1212, a negative pressure control component or ink storing element (not shown) and an individual flexible board controlling contact (not shown). Consequently, the first inkjet cartridges 121~129 are respectively embedded into corresponding supporting seats 111 of the printing platform 11 to perform the page-width array print job. Moreover, since each of the first inkjet cartridges 121~129 and the second inkjet cartridges 131~139 is embedded into a corresponding supporting seat 111, if a specified one of the inkjet cartridges of the first page-width array printing unit 12 or the second page-width array printing unit 13 is in an ink exhaustion state or has a breakdown (e.g. the breakdown of the inkjet chip), the specified inkjet cartridge can be individually detached from the printing platform 11 in order to replenish the ink or replace the inkjet chip. In other words, since it is not necessary to replace the whole printing platform 11, the page-width array printing device of the present invention is user-friendly and has reduced operating cost.

In some embodiments, the first page-width array printing module 10 is in communication with an external continuous ink supply system (not shown). Moreover, a plurality of ink supply pipes 1217 (see FIG. 1) are disposed on the top portion of each of the first inkjet cartridges 121~129 and the second inkjet cartridges 131~139 to be externally connected with a transfer pipe (not shown) of the continuous ink supply system. Consequently, the page-width array print job can be continuously performed.

Moreover, since the first inkjet cartridges 121~129 and the second inkjet cartridges 131~139 are respectively embedded into corresponding supporting seats 111 of the printing platform 11, the controlling contacts may be mounted on a vertical plane. For example, the flexible board controlling contact of the first inkjet cartridge 121 may be mounted on a vertical plane (e.g. a lateral surface 110 of the printing platform 11). Consequently, the printing platform 11 has an additional two-dimensional plane for installing the controlling contacts, and the available wiring area for installing the controlling contacts is increased. In comparison with the prior art technology, the process of installing the controlling contacts is simplified.

Please refer to FIGS. 1 and 2 again. A page-width print range is defined by plural first inkjet cartridges and the plural second inkjet cartridges of the first page-width array printing module 10 collaboratively. In this embodiment, the page-width print range which is defined by the nine first inkjet cartridges 121~129 and the nine second inkjet cartridges 131~139 of the first page-width array printing module 10 is 8.2 inches (i.e. 210 mm). That is, the page-width print range covers the width of an A4-sized print medium. It is noted that the number of the inkjet cartridges of the first page-width array printing module 10 may be varied according to the size of the print medium. Consequently, the page-width print range covers the width between 1 inch and 16.5 inches (i.e. 420 mm). That is, the page-width print range covers the width of any-sized print medium which is smaller than the A3-sized print medium. For example, the page-width print range covers the width of the A4-sized print medium (i.e. 8.2 inches), the width of a 4-inch print medium or the width of a 2-inch print medium, but it is not limited thereto.

Figure 3:
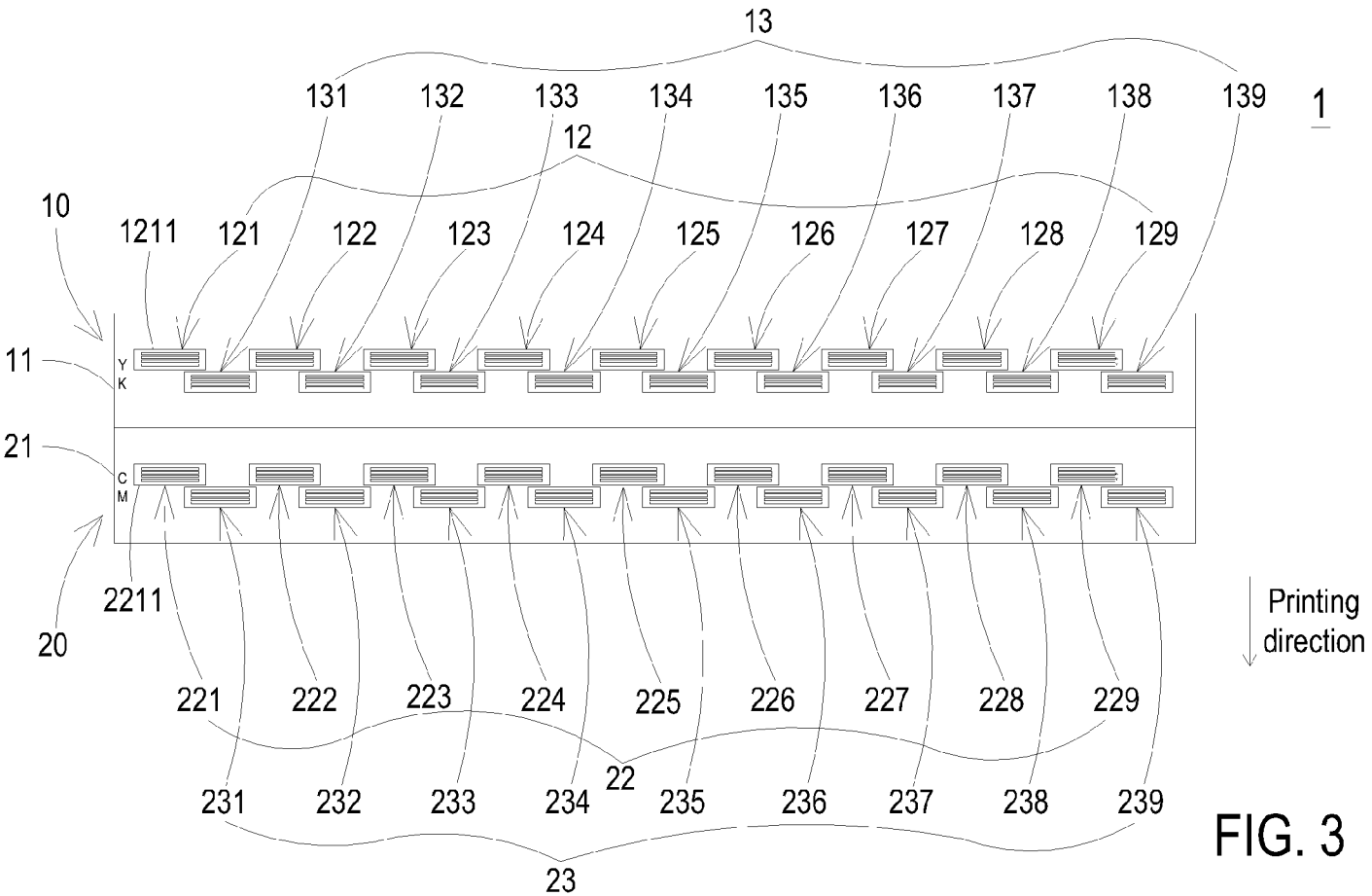
FIG. 3 is schematic view illustrating the arrangement of two page-width array printing modules of the page-width array printing mechanism of the page-width array printing device according to the embodiment of the present invention.

FIG. 3 is schematic view illustrating the arrangement of two page-width array printing modules of the page-width array printing mechanism of the page-width array printing device according to the embodiment of the present invention. As shown in FIG. 3, the page-width array printing mechanism 1 comprises a first page-width array printing module 10 and a second age-width array printing module 20, but it is not limited thereto. The first page-width array printing module 10 comprises a printing platform 11, a first page-width array printing unit 12, and a second page-width array printing unit 13. The first page-width array printing unit 12 and the second page-width array printing unit 13 are disposed on the printing platform 11. The first page-width array printing unit 12 comprises a plurality of first inkjet cartridges (e.g. nine first inkjet cartridges 121~129). The second page-width array printing unit 13 comprises a plurality of second inkjet cartridges (e.g. nine second inkjet cartridges 131~139). The second page-width array printing module 20 comprises a printing platform 21, a third page-width array printing unit 22, and a fourth page-width array printing unit 23. The third page-width array printing unit 22 and the fourth page-width array printing unit 23 are also disposed on the printing platform 21. The third page-width array printing unit 22 comprises a plurality of third inkjet cartridges (e.g. nine third inkjet cartridges 221~229). The fourth page-width array printing unit 23 comprises a plurality of fourth inkjet cartridges (e.g. nine fourth inkjet cartridges 231~239).

In this embodiment, the first page-width array printing module 10 and the second age-width array printing module 20 are in parallel with each other, and aligned with each other. Moreover, the four ink supply channels of each inkjet chip of the plural first inkjet cartridges 121~129 and the plural second inkjet cartridges 131~139 are divided into two homochromatic transportation groups, for example a yellow (Y) transportation group and a black (K) transportation group. The yellow (Y) transportation group is used for transporting a yellow ink such as a dye-based quick drying ink, but it is not limited thereto. The black (K) transportation group is used for transporting a black ink such as a pigment-based quick drying ink. The four ink supply channels of each inkjet chip of the plural third inkjet cartridges 221~229 and the plural fourth inkjet cartridges 231~239 are divided into two homochromatic transportation groups, for example a cyan (C) transportation group and a magenta (M) transportation group. The cyan (C) transportation group is used for transporting a cyan ink. The magenta (M) transportation group is used for transporting a magenta ink. For example, the cyan ink is a dye-based quick drying ink, and the magenta ink is also a dye-based quick drying ink, but it is not limited thereto.

Figure 4:
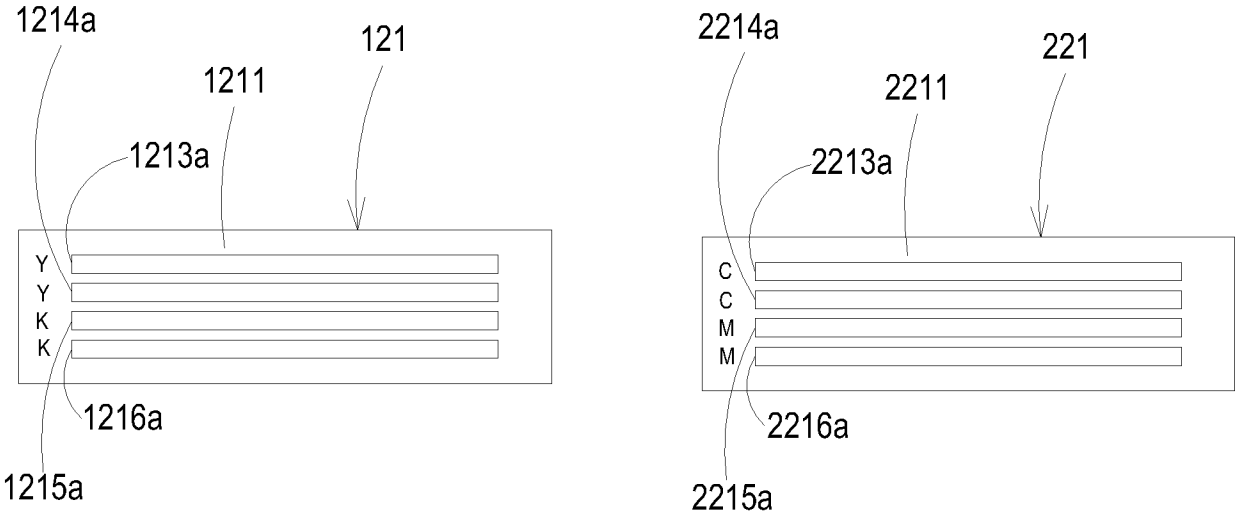
FIG. 4 is a schematic view illustrating the inkjet chips of a first inkjet cartridge of the first page-width array printing module and a third inkjet cartridge of the second page-width array printing module of FIG. 3.

FIG. 4 is a schematic view illustrating the inkjet chips of a first inkjet cartridge of the first page-width array printing module and a third inkjet cartridge of the second page-width array printing module of FIG. 3. In this embodiment, the inkjet chips of the plural first inkjet cartridges 121~129, the plural second inkjet cartridges 131~139, the plural third inkjet cartridges 221~229 and the plural fourth inkjet cartridges 231~239 are ½-inch inkjet chips, but are not limited thereto. As shown in FIG. 4, the inkjet chip 1211 of the first inkjet cartridge 121 has four ink supply channels 1213*a*~1216*a*, and the inkjet chip 2211 of the third inkjet cartridge 221 has four ink supply channels 2213*a*~2216*a*. Moreover, the nozzles of the inkjet chip are arranged at 1200 dpi. Consequently, a monochromatic or polychromatic printing operation can be performed at a high printing speed while achieving the complementary printing function.

Moreover, in this embodiment, the inkjet chips may be configured as bichromatic print films. For example, as shown in FIG. 4, the four ink supply channels 1213*a*~1216*a* of the inkjet chip 1211 of the first inkjet cartridge 121 are divided into two homochromatic transportation groups. In this embodiment, the ink supply channels 1213*a* and 1214*a* belongs to one homochromatic transportation group (e.g. a yellow (Y) transportation group), and the ink supply channels 1215*a* and 1216*a* belongs to the other homochromatic transportation group (e.g. a black (K) transportation group). Similarly, the four ink supply channels 2213*a*~2216*a* of the inkjet chip 2211 of the third inkjet cartridge 221 are divided into two homochromatic transportation groups. In this embodiment, the ink supply channels 2213*a* and 2214*a* belongs to a cyan (C) transportation group, and the ink supply channels 2215*a* and 2216*a* belongs to a magenta (M) transportation group, but it is not limited thereto.

In some embodiments, the four ink supply channels 1213*a*~1216*a* of each inkjet chip of the first inkjet cartridges 121~129 are divided into two homochromatic transportation groups, and the four ink supply channels of each inkjet chip of the second inkjet cartridges 131~139 are divided into other two homochromatic transportation groups. For example, the four ink supply channels 1213*a*~1216*a* of each inkjet chip of the first inkjet cartridges 121~129 are divided into two homochromatic transportation groups of yellow (Y) and black (K), and the four ink supply channels of each inkjet chip of the second inkjet cartridges 131~139 are divided into two homochromatic transportation groups of cyan (C) and magenta (M), but it is not limited thereto. The yellow (Y) transportation group is used for transporting a yellow ink such as a dye-based quick drying ink. The black (K) transportation group is used for transporting a black ink such as a pigment-based quick drying ink. The cyan (C) transportation group is used for transporting a cyan ink. The magenta (M) transportation group is used for transporting a magenta ink. For example, the cyan ink is a dye-based quick drying ink, and the magenta ink is also a dye-based quick drying ink, but it is not limited thereto.

Figure 5:
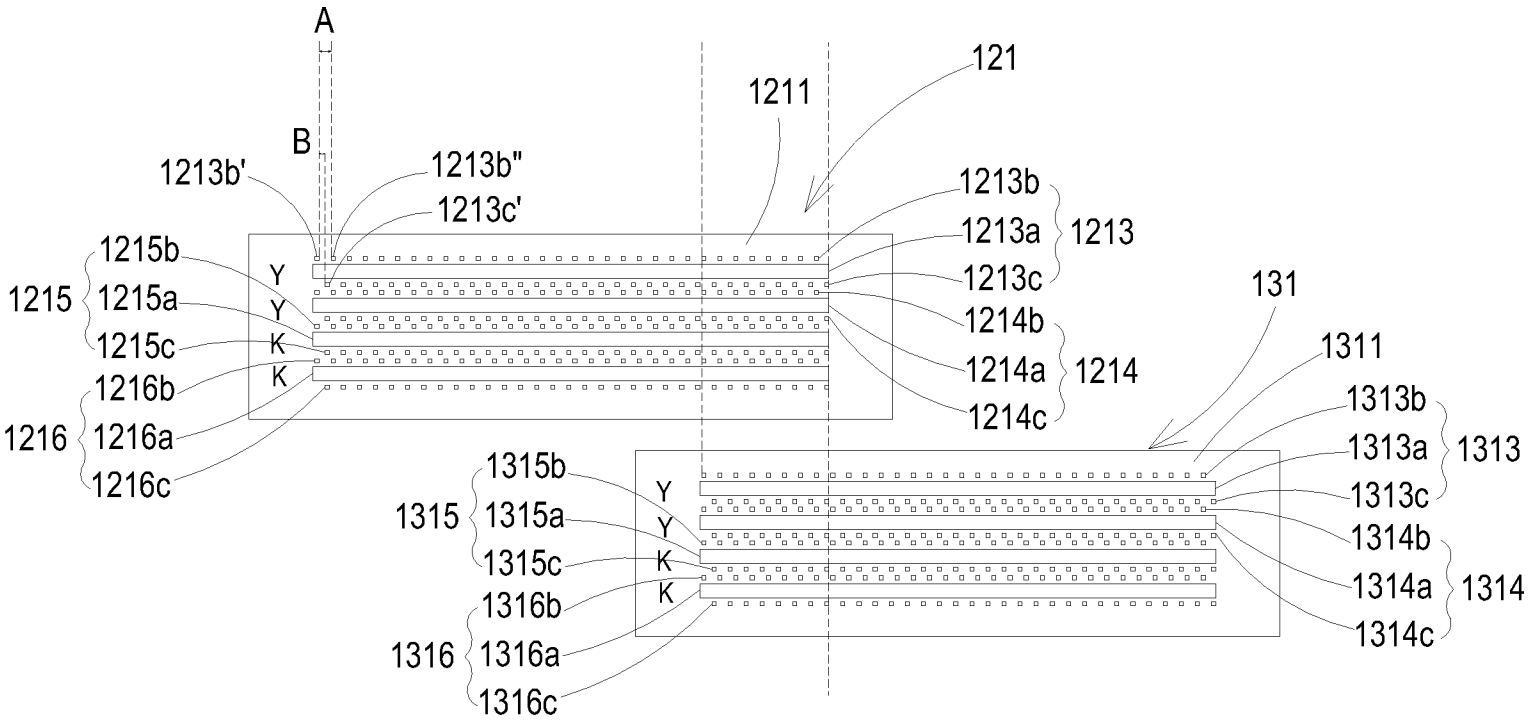
FIG. 5 is a schematic view illustrating the relationship between the inkjet chips of a first inkjet cartridge and a second inkjet cartridge of the first page-width array printing module of the page-width array printing mechanism of FIG. 3.

FIG. 5 is a schematic view illustrating the relationship between the inkjet chips of a first inkjet cartridge and a second inkjet cartridge of the first page-width array printing module of the page-width array printing mechanism of FIG. 3. In this embodiment, the nozzles of the inkjet chip 1211 of the first inkjet cartridge 121 and the inkjet chip 1311 of the second inkjet cartridge 131 are arranged at 1200 dpi. Moreover, the four ink supply channels of the inkjet chip 1211 of the first inkjet cartridge 121 are divided into a yellow (Y) transportation group and a black (K) transportation group. Similarly, the four ink supply channels of the inkjet chip 1311 of the second inkjet cartridge 131 are also divided into a yellow (Y) transportation group and a black (K) transportation group. The yellow (Y) transportation group of the first inkjet cartridge 121 comprises a first inkjet printing group 1213 and a second inkjet printing group 1214 in order to achieve the complementary printing function, and the yellow (Y) transportation group of the second inkjet cartridge 131 comprises a first inkjet printing group 1313 and a second inkjet printing group 1314 in order to achieve the complementary printing function. The black (K) transportation group of the first inkjet cartridge 121 comprises a third inkjet printing group 1215 and a fourth inkjet printing group 1216, and the black (K) transportation group of the second inkjet cartridge 131 comprises a third inkjet printing group 1315 and a fourth inkjet printing group 1316. Moreover, the first inkjet printing group 1213 of the first inkjet cartridge 121 comprises a first nozzle group 1213*b* and a second nozzle group 1213*c*, which are located at two opposite sides of the ink supply channel 1213*a*. Similarly, the second inkjet printing group 1214 comprises a first nozzle group 1214*b* and a second nozzle group 1214*c*, which are located at two opposite sides of the ink supply channel 1214*a*. Similarly, the third inkjet printing group 1215 comprises a first nozzle group 1215*b* and a second nozzle group 1215*c*, which are located at two opposite sides of the ink supply channel 1215*a*. Similarly, the fourth inkjet printing group 1216 comprises a first nozzle group 1216*b* and a second nozzle group 1216*c*, which are located at two opposite sides of the ink supply channel 1216*a*. Moreover, the first inkjet printing group 1313 of the second inkjet cartridge 131 comprises a first nozzle group 1313*b* and a second nozzle group 1313*c*, which are located at two opposite sides of the ink supply channel 1313*a*. Similarly, the second inkjet printing group 1314 comprises a first nozzle group 1314*b* and a second nozzle group 1314*c*, which are located at two opposite sides of the ink supply channel 1314*a*. Similarly, the third inkjet printing group 1315 comprises a first nozzle group 1315*b* and a second nozzle group 1315*c*, which are located at two opposite sides of the ink supply channel 1315*a*. Similarly, the fourth inkjet printing group 1316 comprises a first nozzle group 1316*b* and a second nozzle group 1316*c*, which are located at two opposite sides of the ink supply channel 1316*a*. Each nozzle group comprises a plurality of nozzles. In this embodiment, the spacing distance between every adjacent two nozzles of each nozzle group is 1/600 inch. For example, as shown in FIG. 5, the spacing distance A between the first nozzle 1213*b*' and the second nozzle 1213*b*" of the first nozzle group 1213*b* is 1/600 inch. Moreover, the nozzles of the first nozzle groups 1213*b*~1216*b* and the nozzles of the corresponding second nozzle groups 1213*c*~1216*c* are staggered. In this embodiment, the spacing distance between each nozzle of the first nozzle groups 1213*b*~~1216*b* and the adjacent nozzle of the corresponding second nozzle groups 1213*c*~1216*c* is 1/1200 inch. For example, the spacing distance B between the first nozzle 1213*b*' of the first nozzle group 1213*b* and the first nozzle 1213*c*' of the second nozzle group 1213*c* is 1/1200 inch.

It is noted that the size and resolution of the inkjet chip 1211 or 1311 may be adjusted according to the practical printing requirements. For example, the size of the inkjet chip 1211 or 1311 is 1/6 inch, 1/4 inch, 1/2 inch, 1 inch, 2 inches or 3 inches. Moreover, the resolution of the inkjet chip 1211 or 1311 is 300 dpi, 600 dpi, 1200 dpi, 2400 dpi or higher. Moreover, for complying with the page width of the print medium, the number of the inkjet cartridges and the page-width print range may be adjusted according to the size of the print medium.

Please refer to FIGS. 3 and 5 again. In the first page-width array printing module 10 of this embodiment, the plural first inkjet cartridges 121~129 of the first page-width array printing unit 12 and the plural second inkjet cartridges 131~139 of the second page-width array printing unit 13 are staggered. Moreover, a part of each second inkjet cartridge faces a part of an adjacent first inkjet cartridge along a vertical direction. For example, eight nozzles at a front end of the second inkjet cartridge 131 face eight nozzles at a rear end of the first inkjet cartridge 121. Consequently, the influence of the mechanical assembling tolerance of the plural first inkjet cartridges 121~129 of the first page-width array printing unit 12 and the plural second inkjet cartridges 131~139 of the second page-width array printing unit 13 on the inkjet printing performance will be minimized.

From the above descriptions, the page-width array printing mechanism of the present invention can be applied to a page-width array printing device. The page-width array printing mechanism comprises at least one page-width array printing module for performing a page-width print job. The page-width array printing module comprises two page-width array printing units. Each page-width array printing unit comprises a plurality of inkjet cartridges. For complying with the page width of the print medium, the number of the inkjet cartridges and the page-width print range may be adjusted according to the size of the print medium. Moreover, according to resolution requirements or the practical situations, each inkjet cartridge may be detached from the page-width array printing module and replaced with a new one. Under this circumstance, the printing quality is enhanced. Optionally, each inkjet cartridge may be externally connected with a continuous ink supply system, so that the page-width array print job can be continuously performed.

Moreover, the page-width array printing mechanism of the present invention further comprises a printing platform. The inkjet cartridges are respectively embedded into corresponding supporting seats of the printing platform. Consequently, the ink supply channels are simplified. In case that a specified one of the inkjet cartridges is in an ink exhaustion state or has a breakdown, the specified inkjet cartridge may be replaced with a new one. Moreover, since the inkjet cartridges are respectively embedded into corresponding supporting seats of the printing platform, the controlling contacts may be mounted on a vertical plane. Consequently, the printing platform has an additional two-dimensional plane for installing the controlling contacts, and the available wiring area for installing the controlling contacts is increased. In comparison with the prior art technology, the process of installing the controlling contacts is simplified.

From the above descriptions, the page-width array printing mechanism of the page-width array printing device of the present invention is a modular printing mechanism with plural independent inkjet cartridges. Since it is not necessary to replace the whole printing platform, the processes of assembling the printing platform, replenishing the ink or replacing the inkjet cartridges are more convenient and cost-effective. Moreover, the number of the inkjet cartridges and the page-width print range may be adjusted according to the size of the print medium and the desired resolution. Consequently, the page-width array printing device of the present invention has industrial applicability.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A page-width array printing device comprising:

a page-width array printing mechanism having at least one page-width array printing module, said page-width array printing module comprising:

a printing platform;

a first page-width array printing unit comprising a plurality of first inkjet cartridges, which are discretely arranged on said printing platform at an equal distance; and a second page-width array printing unit comprising a plurality of second inkjet cartridges, which are discretely arranged on said printing platform at an equal distance, wherein said first page-width array printing unit and said second page-width array printing unit are in parallel with each other, said plurality of first inkjet cartridges and said plurality of second inkjet cartridges are staggered and misaligned with each other, wherein eight nozzles at a front end of each said second inkjet cartridge face eight nozzles at a rear end of said adjacent first inkjet cartridge along said vertical direction, and each of said first inkjet cartridges and said second inkjet cartridges is independently and detachably disposed on said printing platform, wherein each of said first inkjet cartridges and said second inkjet cartridges comprises an inkjet chip, an ink reservoir and a flexible board controlling contact, wherein each said inkjet chip comprises four ink supply channels, said four ink supply channels of each said inkjet chip of said first inkjet cartridges and said second inkjet cartridges are divided into two homochromatic transportation groups, wherein each homochromatic transportation group comprises a first inkjet printing group and a second inkjet printing group for achieving a complementary printing function, so as to perform a page-width array printing operation.

2. The printing device according to claim 1, wherein each of said first inkjet printing group and said second inkjet printing group comprises a first nozzle group and a second nozzle group, wherein said first nozzle group and said second nozzle group are located at two opposite sides of said corresponding ink supply channel, wherein each of said first nozzle group and said second nozzle group comprises a plurality of nozzles, and said nozzles of said first nozzle group and said nozzles of said second nozzle group are staggered, wherein a spacing distance between every two adjacent nozzles of said first nozzle group is 1/600inch, a spacing distance between every two adjacent nozzles of said second nozzle group is 1/600inch, and a spacing distance between each nozzle of said first nozzle group and a corresponding nozzle of said second nozzle group is 1/1200inch.

3. The printing device according to claim 1, wherein said four ink supply channels of each said inkjet chip of said first inkjet cartridges are divided into two homochromatic transportation groups of yellow ink and black ink, wherein said yellow ink is a dye-based quick drying ink, and said black ink is a pigment-based quick drying ink.

4. The printing device according to claim 3, wherein said four ink supply channels of each said inkjet chip of second inkjet cartridges are divided into two homochromatic transportation groups of cyan ink and magenta ink, wherein each of said cyan ink and said magenta ink is a dye-based quick drying ink.

5. The printing device according to claim 1, wherein said page-width array printing mechanism comprises:

a first page-width array printing module comprising said plurality of first inkjet cartridges and said plurality of second inkjet cartridges, wherein said four ink supply channels of each said inkjet chip of said first inkjet cartridges and said second inkjet cartridges of said first page-width array printing module are divided into two homochromatic transportation groups of yellow ink and black ink, wherein said yellow ink is a dye-based quick drying ink, and said black ink is a pigment-based quick drying ink; and a second page-width array printing module comprising a plurality of third inkjet cartridges and a plurality of fourth inkjet cartridges, wherein four ink supply channels of each inkjet chip of said third inkjet cartridges and said fourth inkjet cartridges are divided into two homochromatic transportation groups of cyan ink and magenta ink, wherein each of said cyan ink and said magenta ink is a dye-based quick drying ink.

6. The printing device according to claim 1, wherein a page-width print range is defined by said plural first inkjet cartridges and said plural second inkjet cartridges of said at least one page-width array printing module collaboratively, wherein said page-width print range is between 1 inch and 16.5 inches.

7. The printing device according to claim 1, wherein a page-width print range is defined by said first inkjet cartridges and said second inkjet cartridges of said at least one page-width array printing module collaboratively, wherein said page-width print range includes a width selected from 8.2 inches, 4 inches or 2 inches.

8. The printing device according to claim 1, further comprising a continuous ink supply system, wherein said continuous ink supply system is in communication with said first inkjet cartridges and said second inkjet cartridges for continuously supplying ink to said first inkjet cartridges and said second inkjet cartridges.

* * * * *